US009839270B2

(12) United States Patent
Howell et al.

(10) Patent No.: US 9,839,270 B2
(45) Date of Patent: Dec. 12, 2017

(54) DEVICE DISPENSING APPARATUS

(71) Applicant: BRIGHAM YOUNG UNIVERSITY, Provo, UT (US)

(72) Inventors: Larry Howell, Orem, UT (US); Spencer Magleby, Provo, UT (US); Holly Greenburg Nihipali, Davie, FL (US); Samuel Wilding, Springville, UT (US)

(73) Assignee: Brigham Young University, Provo, UT (US)

( * ) Notice: Subject to any disclaimer, the term of this patent is extended or adjusted under 35 U.S.C. 154(b) by 110 days.

(21) Appl. No.: 14/754,050

(22) Filed: Jun. 29, 2015

(65) Prior Publication Data

US 2015/0296943 A1 Oct. 22, 2015

Related U.S. Application Data

(63) Continuation of application No. 13/572,616, filed on Aug. 11, 2012, now Pat. No. 9,067,720.
(Continued)

(51) Int. Cl.
*A45C 11/00* (2006.01)
*A45C 13/34* (2006.01)
(Continued)

(52) U.S. Cl.
CPC ..... *A45C 11/005* (2013.01); *A45C 13/005* (2013.01); *A45C 13/02* (2013.01); *A45C 13/34* (2013.01); *B65D 75/326* (2013.01); *B65D 81/22* (2013.01); *B65D 83/00* (2013.01); *B65D 2575/3218* (2013.01); *B65D 2575/3245* (2013.01); *B65D 2585/545* (2013.01)

(58) Field of Classification Search
CPC ..... A45C 11/005; A45C 13/005; A45C 13/02; A45C 13/34; A61L 12/086; B65D 2585/545; B65D 75/366; B65D 2575/367; B65D 75/326; B65D 8/22; B65D 30/00; B65D 2575/3218; B65D 2575/3245
USPC ..... 206/5.1, 249, 250, 817, 751–752, 754, 206/767
See application file for complete search history.

(56) References Cited

U.S. PATENT DOCUMENTS 1,153,963 A 9/1915 Sengstock
1,732,214 A 8/1927 Amez-Droz
(Continued)

*Primary Examiner* — Chun Cheung
(74) *Attorney, Agent, or Firm* — Brake Hughes Bellermann LLP

(57) ABSTRACT

In one general aspect, an apparatus can include a container including a lid, and a cradle configured to support a device. The apparatus can include a lifting mechanism operably coupled to the cradle and the lid. The lifting mechanism can be configured to move between a storage position where the cradle is disposed in the container to a dispensing position where the cradle is disposed outside of the container. The lifting mechanism can be configured to move between the storage position and the dispensing position in response to moving the lid. The lifting mechanism can include a first link aligned parallel to a second link when the lifting mechanism is in the dispensing position and when the lifting mechanism is in the storage position. The first link and the second link can both be within the same plane when in a position between the storage position and the dispensing position.

21 Claims, 4 Drawing Sheets

Related U.S. Application Data

(60) Provisional application No. 61/677,194, filed on Jul. 30, 2012.

(51) Int. Cl.

| | |
|---|---|
| ***B65D 81/22*** | (2006.01) |
| ***A45C 13/00*** | (2006.01) |
| ***A45C 13/02*** | (2006.01) |
| ***B65D 75/32*** | (2006.01) |
| ***B65D 83/00*** | (2006.01) |

(56) References Cited

U.S. PATENT DOCUMENTS

| | | | | |
|---|---|---|---|---|
| 2,427,218 | A * | 9/1947 | Liebson | A24F 15/06 131/256 |
| 7,325,682 | B2 * | 2/2008 | Seymour | B25H 3/003 206/379 |
| 7,540,376 | B2 | 6/2009 | Mahieu et al. | |
| 8,474,619 | B1 | 7/2013 | Chrisman | |
| 9,067,720 | B2 | 6/2015 | Howell et al. | |
| 2008/0047848 | A1 | 2/2008 | Tokarski et al. | |
| 2016/0198825 | A1 * | 7/2016 | Fawdington | A61F 9/0061 206/5.1 |

* cited by examiner

DEVICE DISPENSING APPARATUS

RELATED APPLICATIONS

This application is a continuation of U.S. patent application Ser. No. 13/572,616, filed on Aug. 11, 2012, entitled, "Contact Lens Dispensing Apparatus," which claims priority to and the benefit of U.S. Provisional Application No. 61/677,194, filed on Jul. 30, 2012, entitled "A Novel Lamina Emergent Mechanism", both of which are incorporated herein by reference in their entireties.

This invention was made with government support under Grant Number NSF-CMMI 0800606 awarded by the National Science Foundation. The government has certain rights in the invention.

TECHNICAL FIELD

This disclosure relates to storage and dispensing of medical devices including a contact lens.

BACKGROUND

Currently available dispensing devices typically require a user to touch the dispensed medical device multiple times previous to using the medical device. Each point and instance of contact with the user may transfer bacteria or germs. What is needed is a low-cost device to dispense a medical device that reduces the number of times that a user is required to touch the dispensed medical device prior to use.

SUMMARY

The present invention has been developed in response to the present state of the art, and in particular, in response to the problems and needs in the art that have not yet been fully solved by currently available dispensing devices and methods. Accordingly, the present invention has been developed to provide an apparatus for dispensing that overcomes many of the shortcomings in the art.

In a general aspect, an apparatus can include a container including a lid, and a cradle including a void and configured to support a device. The apparatus can include a lifting mechanism operably coupled to the cradle and the lid. The lifting mechanism can be configured to move between a storage position where the cradle is disposed in the container to a dispensing position where the cradle is disposed outside of the container. The lifting mechanism can be configured to move between the storage position and the dispensing position in response to moving the lid. The lifting mechanism can include a first link aligned parallel to a second link when the lifting mechanism is in the dispensing position and when the lifting mechanism is in the storage position.

The present invention provides a variety of advantages. It should be noted that references to features, advantages, or similar language within this specification does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The aforementioned features and advantages of the present invention will become more fully apparent from the following description and appended claims, or may be learned by the practice of the invention as set forth hereinafter.

BRIEF DESCRIPTION OF THE DRAWINGS

To enable the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1A:
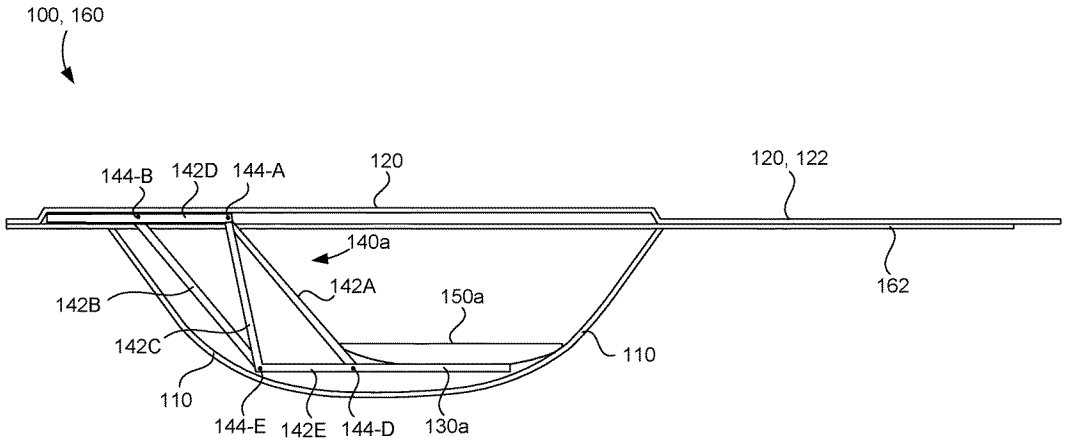
FIGS. 1*a* and 1*b* are cross-sectional side view illustrations depicting one embodiment of a contact lens dispensing apparatus of the present invention.
Figure 1B:
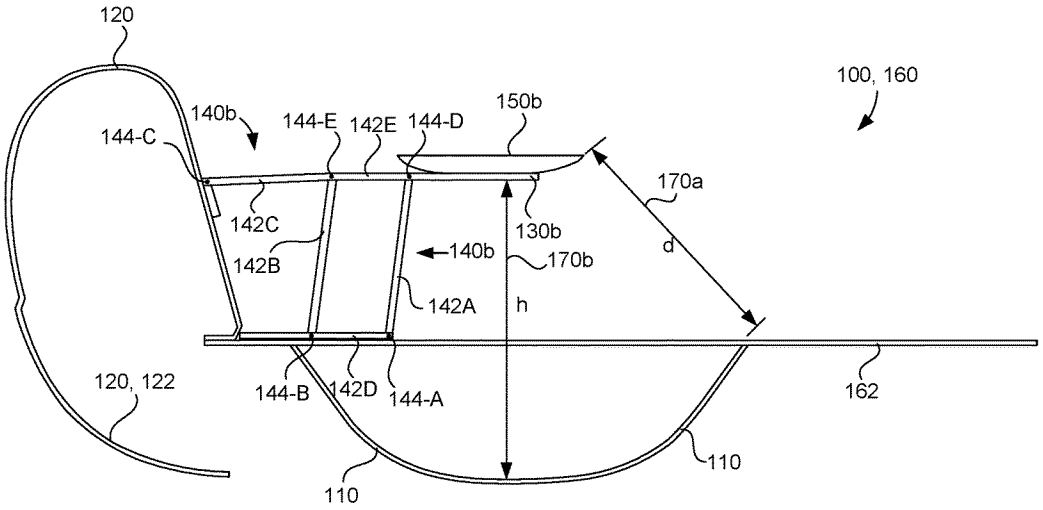

FIGS. 1*a* and 1*b* are cross-sectional side view illustrations depicting one embodiment of a contact lens dispensing apparatus 100 of the present invention. As depicted, the apparatus 100 includes a container 110 with a lid 120, a cradle 130, a lifting mechanism 140, and a contact lens 150. FIG. 1*a* shows the lifting mechanism 140 in a storage position 140 *a* while FIG. 1*b* shows the lifting mechanism in a dispensing position 140 *b*.

In the depicted embodiment, the container 110 is a bowl with a foil lid 120 that covers the bowl. The depicted bowl 110 and foil lid 120 collectively comprise a blister pack 160. The lid 120 may removably seal the container 110 and protect the contact lens from foreign matter including bacteria. In the depicted embodiment, the blister pack 160 and the foil lid 120 comprise peeling tabs 122 and 162 that facilitate removal of the lid 120.

The cradle 130 may cradle a contact lens placed thereon and enable a user to slide the contact lens off of the cradle with an index finger or the like (not shown) placed below the cradle 130 when the lifting mechanism 140 is in the dispensing position 140 *b*.

As shown in FIGS. 1 *a* and 1 *b*, the lifting mechanism 140 may include a number of links 142 (e.g., links 142A through 142E) and hinge points 144 (e.g., hinges 144-A through 144-E) that facilitate translational movement of the cradle relative to the container 110. In some implementations, the link 142A is a first link, the link 142B is a second link, the link 142C is a third link, the link 142D is a fourth link, and the link 142E is a fifth link. In some implementations, the hinge 144-A is a first hinge, the hinge 144-B is a second hinge, the hinge 144-C is a third hinge, the hinge 144-D is a fourth hinge, and the hinge 144-E is a fifth hinge. Furthermore, the lifting mechanism may be connected to the cradle and the lid in a manner that causes the lifting mechanism 140 to lift the cradle 130 from a storage position 130 *a* within the container 110 to a dispensing position 130 *b* above the container in response to opening the lid 120 of the container 110. The lifting mechanism may be configured to provide a minimal clearance 170 *a* and a vertical clearance 170 *b* that is sufficient for most individuals to insert an index finger between the container 110 and the cradle 130 and/or the contact lens 150. In one embodiment, the minimal clearance 170 *a* and the vertical clearance 170 *b* are greater than 12 mm.

In certain embodiments, the hinge points 144 comprise living hinges made of the same material as the links 142 connected thereto. In some embodiments, the links 142 have lengths that correspond to a dyad four-bar or a parallel four-bar. The lifting mechanism 140 and the cradle 130 may collectively comprise a laminar emergent mechanism that is integrally formed from a planar sheet of material such as a sheet of plastic material.

Figure 2:
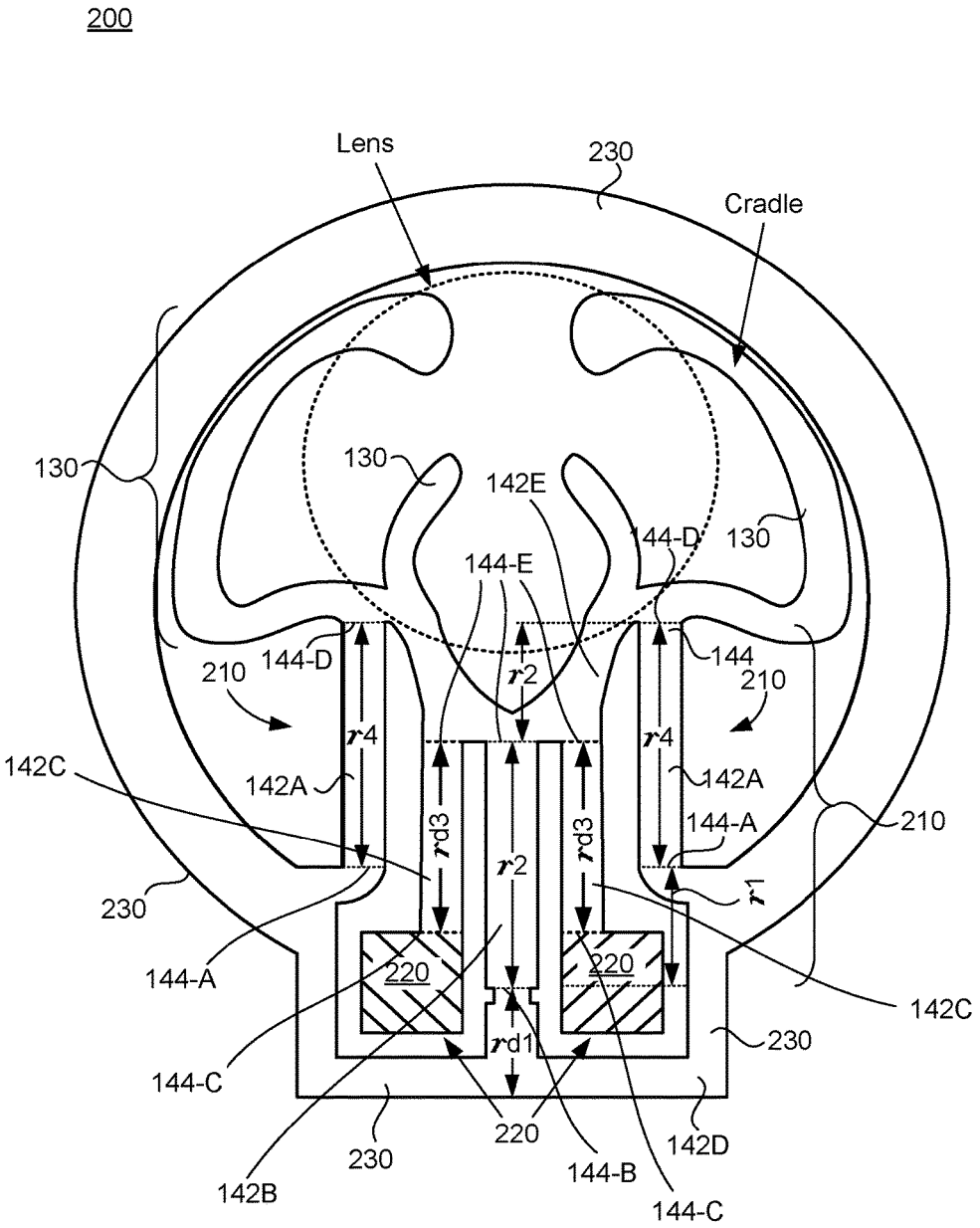
FIG. 2 is a top view illustration of a laminar mechanism of the present invention.

FIG. 2 is a top view illustration of one specific embodiment of a laminar mechanism 200 of the present invention. As depicted, the laminar mechanism 200 includes a cradle 130, a lifting mechanism 210, one or more attachment pads 220, and a rim 230. The laminar mechanism is an emergent mechanism that may be leveraged within the contact lens dispensing apparatus 100.

The cradle 130, the lifting mechanism 210, the attachment pads 220 and the rim 230 may be integrally formed from a planar sheet of material such as a plastic. The cradle 130 may include a void 132 that enables a user to make contact with the non-eye (bottom) side of a lens placed on the cradle 130. As depicted, the lifting mechanism 210 includes a number of links 142 with hinge points 144 that enable the mechanism 210 to move in response to movement of the attachment pads 220 (e.g. in an out of the page) relative to the rim 230. The rim 230 may be attached to a container such as the container 110. Movement of the attachment pads 220 can also cause the cradle 130 to move to a storage position or a dispensing position similar to what is shown in FIG. 1.

In the depicted embodiment, the hinge points 144 comprise living hinges made of the same material as the links 142 connected thereto. In some embodiments, the links have lengths r that correspond to a dyad four-bar or a parallel four-bar.

Figure 3:
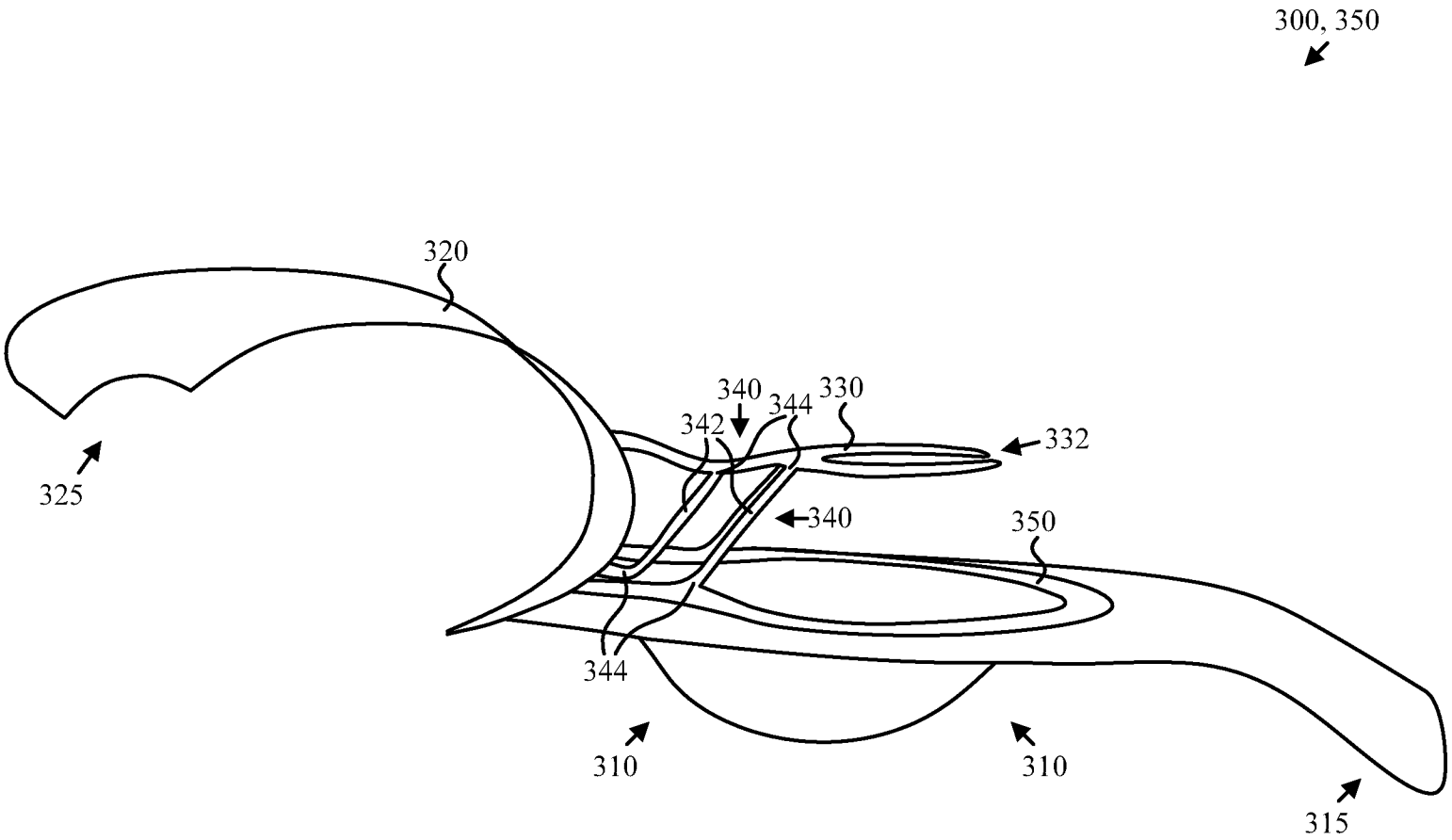
FIG. 3 is a perspective view illustration depicting one embodiment of a contact lens dispensing apparatus of the present invention.

FIG. 3 is a perspective view illustration depicting one specific embodiment of a contact lens dispensing apparatus 300 of the present invention. As depicted, the apparatus 300 includes a container 310 with a peeling tab 315, a lid 320 with a peeling recess 325, a cradle 330 with a void 332, a lifting mechanism 340 and a rim 350. The apparatus 300 is shown in a dispensed state where a user has peeled away the lid from the container 310 and moved the cradle 330 to a dispensing position via the lifting mechanism 340.

In the depicted embodiment, the container 310 is a bowl with a lid 320 that covers the bowl when the apparatus is in a storage state (not shown). The lid 320 may comprise a foil. The container 310 and the lid 320 collectively comprise a blister pack 350 shown in an opened state. While the apparatus 300 is in the storage state the lid 320 may removably seal the container 310 and protect the contact lens from foreign matter including bacteria. In the depicted embodiment, the peeling tab 315 and peeling recess 325 facilitate peeling the lid 320 away from the container 310.

As depicted, the lifting mechanism 340 may include a number of links 342 and hinge points 344 that facilitate translational movement of the cradle 330 relative to the container 310. In the depicted embodiment, the hinge points 344 comprise living hinges made of the same material as the links 342 connected thereto. The links may have lengths that correspond to a dyad four-bar or a parallel four-bar.

The cradle 330 and the lifting mechanism 340 may be encompassed by a rim 350. The rim 350 may be attached to the container 310 and provide a base for the lifting mechanism 340. The depicted rim 350, lifting mechanism 340 and cradle 330 collectively comprise a laminar emergent mechanism that is integrally formed from a planar sheet of material such as a sheet of plastic material.

In response to peeling the foil lid 320 away from the container 310, the lifting mechanism 340 may complete the translation movement of the cradle 330 to the shown dispensing position. Once the cradle is in the dispensing position a user may remove a contact lens for placement upon an eye by touching the non-eye side of a lens through the void 332 and sliding the lens off of the cradle 330.

The present invention provides a low-cost device to dispense a contact lens that reduces the number of times that a user is required to touch a contact lens previous to placing the contact lens upon the eye. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a container including a lid;

a cradle configured to support a device; and a lifting mechanism operably coupled to the cradle and the lid, the lifting mechanism configured to move between a storage position where the cradle is disposed in the container to a dispensing position where the cradle is disposed outside of the container, the lifting mechanism configured to move between the storage position and the dispensing position in response to moving the lid, the lifting mechanism including a first link aligned parallel to a second link when the lifting mechanism is in the dispensing position and when the lifting mechanism is in the storage position, the first link and the second link both being within the same plane when in a position between the storage position and the dispensing position.

2. The apparatus of claim 1, wherein the device is a contact lens.

3. The apparatus of claim 1, wherein the lid is a removable lid.

4. The apparatus of claim 1, wherein the lifting mechanism includes a third link hingedly coupled to the first link and aligned non-parallel to the first link when the lifting mechanism is in the storage position.

5. The apparatus of claim 1, wherein the lifting mechanism includes a third link hingedly coupled to the first link and aligned non-parallel to the first link and to the second link when the lifting mechanism is in the storage position or in the dispensing position.

6. The apparatus of claim 1, wherein the first link and the second link are included in a plurality of links, the lifting mechanism includes a plurality of hinge points.

7. The apparatus of claim 1, wherein the lifting mechanism includes a living hinge coupled to the first link.

8. The apparatus of claim 1, wherein the first link and the second link define at least a part of a dyad four-bar.

9. The apparatus of claim 1, wherein the lifting mechanism and the cradle are formed from a planar sheet of material.

10. The apparatus of claim 1, wherein the lifting mechanism and the cradle are collectively included in a laminar mechanism.

11. The apparatus of claim 1, further comprising:

a rim coupled to the lifting mechanism and coupled to the container.

12. An apparatus, comprising:

a container including a lid;

a cradle configured to support a device; and a lifting mechanism operably coupled to the cradle and the lid, the lifting mechanism configured to move between a storage position where the cradle is disposed in the container to a dispensing position where the cradle is disposed outside of the container, the lifting mechanism configured to move between the storage position and the dispensing position in response to moving the lid, the lifting mechanism including a first link configured to move in parallel with a second link, the lifting mechanism including a third link having an end coupled to the lid, the first link having an end, the end being disposed above the cradle when the lifting mechanism is in the storage position and being disposed below the cradle when the lifting mechanism is in the dispensing position.

13. The apparatus of claim 12, wherein the container is configured to retain a fluid.

14. The apparatus of claim 12, wherein the first link is aligned parallel to the second link when the lifting mechanism is in the dispensing position and when the lifting mechanism is in the storage position.

15. The apparatus of claim 12, wherein the first link, the second link, and the third link, are configured to be aligned within a plane at a position between the dispensing position and the storage position.

16. The apparatus of claim 12, wherein the third link is aligned non-parallel to the first link and the second link when the lifting mechanism is in the storage position or in the dispensing position.

17. An apparatus, comprising:

a container including a lid;

a cradle configured to support a device; and a lifting mechanism operably coupled to the cradle and the lid, the lifting mechanism configured to move between a storage position where the cradle is disposed in the container to a dispensing position where the cradle is disposed outside of the container, the lifting mechanism configured to move between the storage position and the dispensing position in response to moving the lid, the lifting mechanism including a first link having a first hinge aligned along a first axis, a second link having a second hinge aligned along a second axis different from the first axis, and a third link being hingedly coupled to the lid via a third hinge aligned along a third axis different from the first axis and the second axis, the third hinge aligned along the third axis being moved away from the first hinge aligned along the first axis and the second hinge aligned along the second axis when the lifting mechanism is moved from the storage position to the dispensing position.

18. The apparatus of claim 17, wherein the first axis is parallel to the second axis and the third axis when the lifting mechanism is in the dispensing position and when the lifting mechanism is in the storage position.

19. The apparatus of claim 17, wherein the first link has a length equal to a length of the second link.

20. The apparatus of claim 17, wherein the third link is aligned non-parallel to the first link and the second link when the lifting mechanism is in the storage position or in the dispensing position.

21. The apparatus of claim 17, wherein the third link has a portion disposed in an area between the first link and the second link when the lifting mechanism is in the storage position, the portion of the third link being disposed outside of the area between the first link and the second link when the lifting mechanism is in the dispensing position.

* * * * *